United States Patent [19]

Loomis, III

[11] 4,137,819

[45] Feb. 6, 1979

[54] LAUNCH TUBE ANTENNA

[75] Inventor: Jester M. Loomis, III, Huntsville, Ala.

[73] Assignee: The United States of America as represented by the Secretary of the Army, Washington, D.C.

[21] Appl. No.: 855,149

[22] Filed: Nov. 28, 1977

[51] Int. Cl.[2] ..... F41F 3/04

[52] U.S. Cl. ..... 89/1.813; 89/1.816; 343/895

[58] Field of Search ..... 343/895, 904; 89/1.816, 89/1.813, 1.8

[56] References Cited

U.S. PATENT DOCUMENTS

| | | | |
|---|---|---|---|
| 1,284,155 | 11/1918 | Shartzer | 343/895 X |
| 3,757,345 | 9/1973 | Carver | 343/895 X |
| 3,828,353 | 8/1974 | Majkrzak et al. | 343/895 X |
| 4,008,478 | 2/1977 | Ikrath et al. | 343/895 X |

FOREIGN PATENT DOCUMENTS

| | | | |
|---|---|---|---|
| 159016 | 5/1957 | Sweden | 89/1.813 |
| 720114 | 12/1954 | United Kingdom | 343/895 X |

*Primary Examiner*—David H. Brown

*Attorney, Agent, or Firm*—Nathan Edelberg; Robert P. Gibson; Charles R. Carter

[57] ABSTRACT

An antenna mounted within a missile launch tube which acts as a communication link between the launcher and the missile. The launch tube is made of fiberglass with a metallic conductor embedded therein to provide radio frequency radiation. The antenna is in the form of a helical conductor and provides radiation in the tube's axial direction.

3 Claims, 1 Drawing Figure

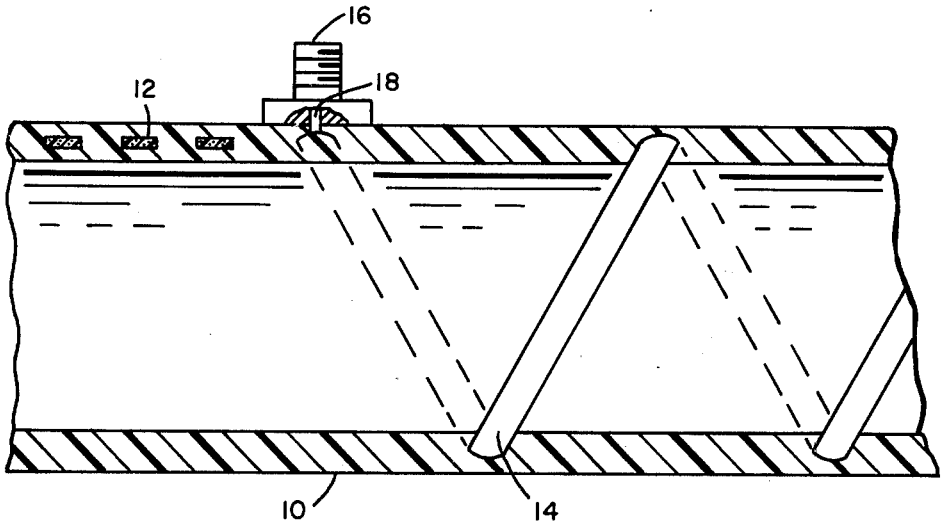
16
18
12
10
14

LAUNCH TUBE ANTENNA

DEDICATORY CLAUSE

The invention described herein may be manufactured, used, and licensed by or for the Government for governmental purposes without the payment to me of any royalties thereon.

BACKGROUND OF THE INVENTION

This invention relates to the field of antennas. Currently, several military missiles are launched from tubes. The tubes are made from either fiberglass or steel, and for the most part are used for storage. After missile firing communications between the missile and launcher is carried out by using wire or some other link such as radio frequency or infrared provided by an auxiliary unit.

SUMMARY OF THE INVENTION

The present invention provides for an antenna to be mounted within a missile launch tube. The launch tube is made of fiberglass with a metallic conductor embedded therein to provide radio frequency radiation. This antenna could then be used as part of a transmit or receive device for a communication link between the operator and the missile. This invention would provide a simple and inexpensive method to communicate between the missile and operator.

This invention may be better understood from the following detailed description taken in conjunction with the accompanying drawing.

BRIEF DESCRIPTION OF THE DRAWING

The single FIGURE shown in the drawing illustrates the antenna in place in the launch tube.

DESCRIPTION OF THE PREFERRED EMBODIMENT

Reference numeral 10 represents a missile launch tube made of fiberglass having wiring 12 embedded in one end of the tube for arming and firing the missile. An antenna 14 is embedded beneath the internal surface of the tube 10 as is shown as a helical conductor. The antenna could be of other types such as loops with the primary requirement being to provide radiation in the tube's axial direction. An RF connector 16 is placed on the tube body for ease of connection to the antenna at 18. Communications is established merely by pointing the tube in the direction of the missile and transmitting or receiving, depending upon the requirements.

I claim:

1. A tube for launching a missile and providing a communication link between the tube and the operator, comprising: a launch tube made of fiberglass material; arm and fire wiring disposed at one end of said tube, and an antenna embedded in said tube and disposed from said wiring for providing communication signals from the operator to the missile while in flight.

2. A tube as set forth in claim 1 wherein said antenna is in the form of a helical conductor.

3. A tube as set forth in claim 2 wherein said tube is provided with a connector for connection with said antenna.

* * * * *